US007599777B2

(12) United States Patent
Passeri et al.

(10) Patent No.: US 7,599,777 B2
(45) Date of Patent: Oct. 6, 2009

(54) ADJUSTABLE PANTOGRAPH CONFIGURATION FOR AN INDUSTRIAL VEHICLE

(75) Inventors: Gianni Passeri, Virgilio (IT); Riccardo Appiani, Cavenago Brianza (IT)

(73) Assignee: NMHG Oregon, LLC, Portland, OR (US)

( * ) Notice: Subject to any disclaimer, the term of this patent is extended or adjusted under 35 U.S.C. 154(b) by 288 days.

(21) Appl. No.: 11/404,573

(22) Filed: Apr. 13, 2006

(65) Prior Publication Data

US 2006/0280585 A1 Dec. 14, 2006

Related U.S. Application Data

(60) Provisional application No. 60/673,912, filed on Apr. 22, 2005, provisional application No. 60/671,713, filed on Apr. 14, 2005.

(51) Int. Cl.
*B66F 9/14* (2006.01)

(52) U.S. Cl. ..... 701/50; 56/79; 56/97; 414/667; 37/419; 187/222

(58) Field of Classification Search ..... 701/50; 56/79, 97, 87; 414/667, 687; 37/419; 172/4.5; 187/222
See application file for complete search history.

(56) References Cited

U.S. PATENT DOCUMENTS 3,885,692 A * 5/1975 Anderson, Jr. ..... 414/660
3,998,288 A * 12/1976 Aoki ..... 180/211
4,413,708 A * 11/1983 Stedman ..... 187/222
4,497,607 A * 2/1985 Johannson ..... 414/664
4,627,013 A * 12/1986 Ichiyama et al. ..... 702/174
4,775,024 A * 10/1988 Pircher ..... 180/168
4,893,689 A * 1/1990 Laurich-Trost ..... 180/414
4,942,529 A 7/1990 Avitan et al. ..... 364/424.01
5,052,882 A * 10/1991 Blau et al. ..... 414/667
5,325,935 A * 7/1994 Hirooka et al. ..... 180/211
5,995,001 A 11/1999 Wellman et al. ..... 340/438
6,059,514 A * 5/2000 Sanchez ..... 414/661
6,112,612 A * 9/2000 Seksaria et al. ..... 74/471 XY
6,135,694 A 10/2000 Trego et al. ..... 414/21
6,611,746 B1 * 8/2003 Nagai ..... 701/50
7,366,600 B2 * 4/2008 Osaki et al. ..... 701/50
2003/0024132 A1 * 2/2003 Kokura et al. ..... 33/712
2003/0097213 A1 * 5/2003 Cessac ..... 701/50
2004/0024510 A1 * 2/2004 Finley et al. ..... 701/50
2004/0179925 A1 * 9/2004 O'Keeffe ..... 414/467
2004/0255563 A1 * 12/2004 Schafer ..... 56/1
2005/0044753 A1 * 3/2005 Lohnes et al. ..... 37/348

OTHER PUBLICATIONS

Hyster Brochure Part No. DLRCAP/B, Jan. 2004.

* cited by examiner

*Primary Examiner*—Tuan C To
(74) *Attorney, Agent, or Firm*—Stolowitz Ford Cowger LLP

(57) ABSTRACT

A load handling system of an industrial vehicle includes a pantograph attachment that provides a variable reach. A sensor provides position feedback for the pantograph attachment. A processor then determines a maximum allowable reach of the pantograph attachment according to the position feedback and other vehicle operating parameters.

21 Claims, 5 Drawing Sheets

ADJUSTABLE PANTOGRAPH CONFIGURATION FOR AN INDUSTRIAL VEHICLE

This application claims priority from U.S. Provisional Application 60/671,713 filed on Apr. 14, 2005, and U.S. Provisional Application 60/673,912, filed Apr. 22, 2005, both of which are herein incorporated by reference.

BACKGROUND OF THE INVENTION

The invention relates to an attachment of an industrial vehicle, including forklift trucks, that manipulates or handles a load under monitored operation conditions.

Industrial vehicles, including forklift trucks, may be fitted with a large variety of attachments, for example, which may be mounted on an end of the vehicle. These attachments may be used to lift, carry, transport or otherwise manipulate a load or object which requires some level of dexterity and care so that the load is not damaged or inadvertently dropped. Forks, clamps, buckets, shovels and any number of other attachments have been designed for handling a load. Furthermore, the attachments may be fitted with hydraulic devices that enable different side-shift, tilt, rotate and/or lift operations. This wide variety of attachments and attachment operations can create a significant transfer of load moment and affect vehicle stability, particularly when the load is at an elevated position.

Conventional industrial vehicles may often be required to lift or handle a load that is located a certain distance away from the vehicle. For example a forklift truck may include forks to pick up the load. Fork spacers may be inserted on the forks to extend the attachment reach when it is not convenient to move the vehicle closer to the load. The fork spacers increase the total length of the vehicle and can negatively affect the maneuverability or turning radius of the vehicle. Different amounts of attachment reach may be desired that may require different length fork spacers. The installation time required to attach different length fork spacers reduces the time efficiency of the lift truck.

A "double bite" technique may be used when handling a remote load. The "double bite" technique is an operation where a forklift truck lifts a load with an outer portion of the forks, traverses backward a distance, sets the load down on the ground, and then moves forward and fully engages the load. A load should be fully engaged during transportation and handling. Double biting a load can cause damage to a load, place stress on the forks, and result in operating inefficiencies.

In some industrial vehicles, a pantograph mechanism may be provided that enables a load handling device to be extended and retracted. As the pantograph mechanism is extended, a moment associated with the load weight increases and may destabilize the vehicle.

Conventional industrial vehicles including travel speed restrictions determine a maximum allowable travel speed as a function of lift height or other operating parameters. Travel speed may be varied in steps according to threshold lift height values, or the travel speed may be varied linearly as a function of lift height. These travel speed restrictions result in limiting vehicle performance to a worst case vehicle stability condition, and therefore reduce operational efficiencies in many applications.

Conventional industrial vehicles may include lift height restrictions, for example, to reduce a risk of damaging the mast or load inside of a warehouse facility. These systems also reduce operational efficiencies.

The present invention addresses these and other problems associated with the prior art.

SUMMARY OF THE INVENTION

A load handling system of an industrial vehicle includes a pantograph attachment that provides a variable horizontal reach. A sensor provides position feedback for the pantograph attachment. A processor then determines a maximum allowable reach of the pantograph attachment according to the position feedback and other vehicle operating parameters.

The foregoing and other objects, features and advantages of the invention will become more readily apparent from the following detailed description of a preferred embodiment of the invention which proceeds with reference to the accompanying drawings.

DETAILED DESCRIPTION

Figure 1:
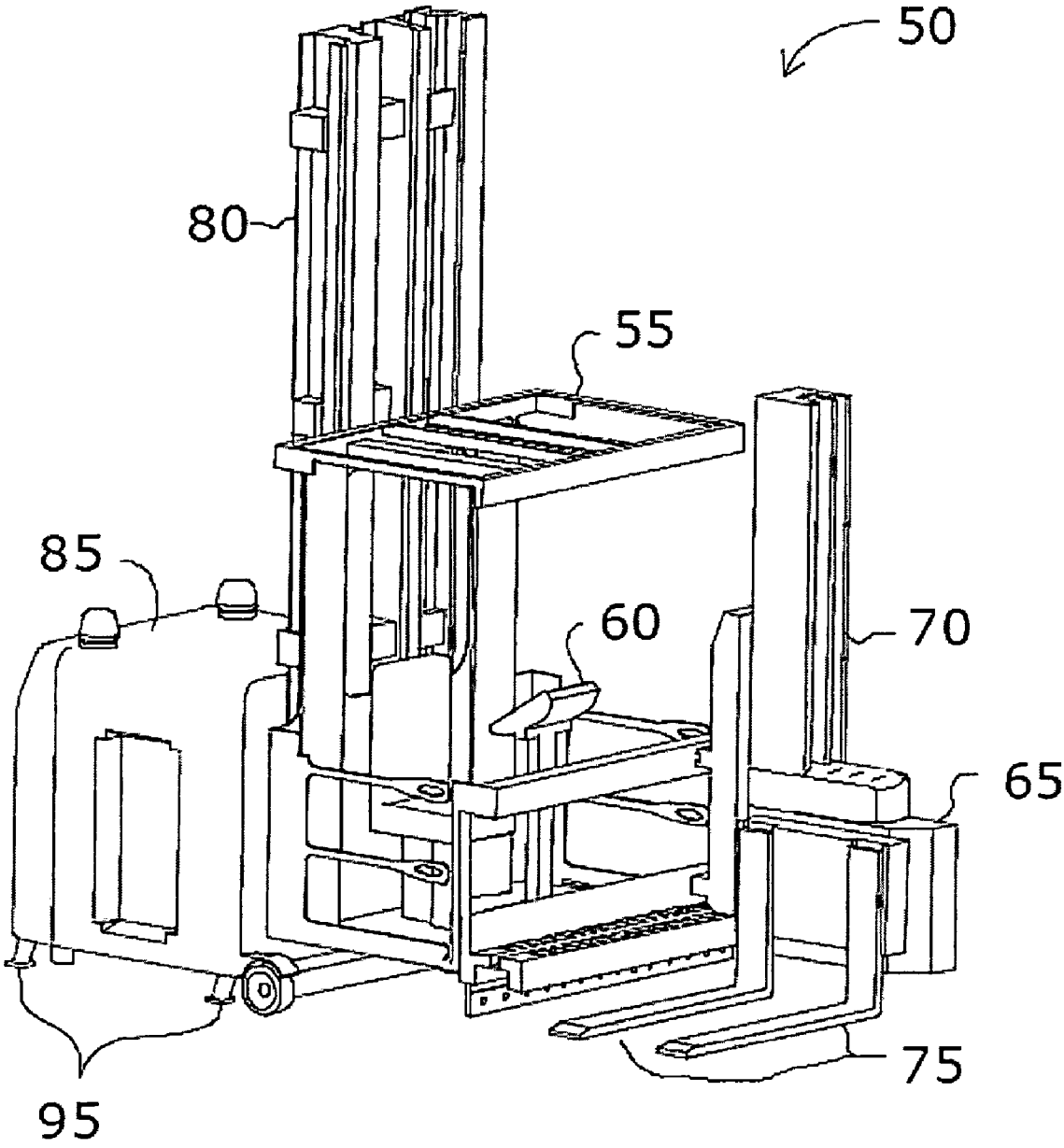
FIG. 1 is an elevated perspective view of an industrial truck that operates a variable length attachment.

FIG. 1 provides an elevated perspective view of an example industrial vehicle 50 that may utilize a novel attachment system. Specifically, the industrial vehicle 50 shown in FIG. 1 is a man-up turret truck, or a very narrow aisle (VNA) lift truck. However, other types of industrial vehicles, including other forklift trucks, are similarly contemplated herein and claimed.

The industrial vehicle 50 of FIG. 1 may include an operator cabin 55, operator controls 60, attachment 65, auxiliary mast 70, forks 75, main mast 80, motor compartment 85 and stabilizers 95. The operator controls 60 may control a number of different functions, some of which may include hydraulic functions. An operator (not shown) standing or sitting in the operator cabin 55, may use the operator controls 60 to raise and lower the operator cabin 55 attached to the main mast 80. Similarly the operator controls 60 may be used to raise or lower the attachment 65 and forks 75 that are attached to the auxiliary mast 70.

Optional stabilizers 95 may be located underneath the industrial vehicle 50 and may be raised and lowered using the operator controls 60 or in response to a vehicle operation such as raising the operator cabin 55. Stabilizers 95 may be included on either side of the industrial vehicle 50, for example, to provide additional lateral support.

Figure 2:
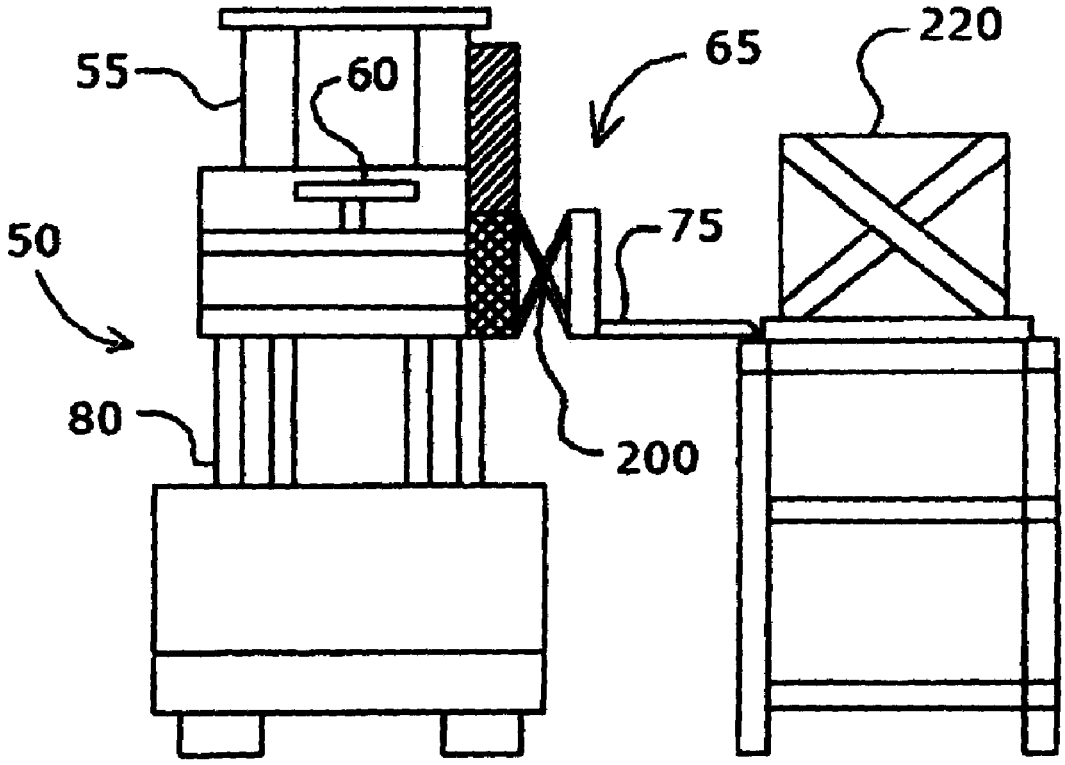
FIG. 2 is a partial front view of the industrial truck of FIG. 1 showing the variable length attachment located in a retracted position.
Figure 3:
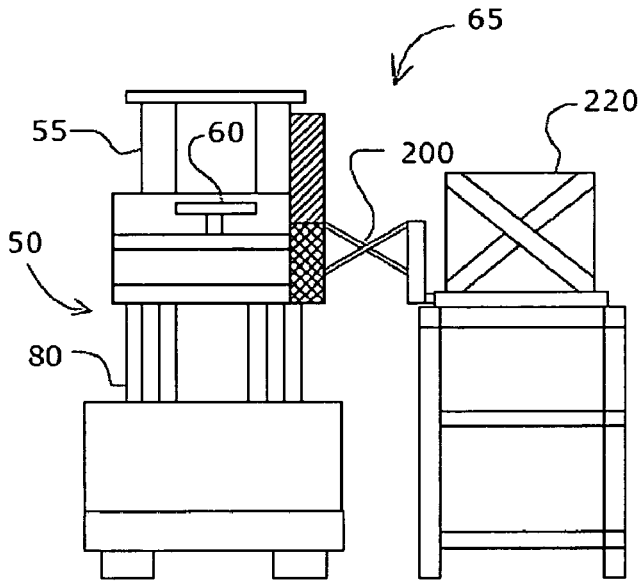
FIG. 3 is a partial front view of the industrial truck of FIG. 1 showing the attachment engaging a load in an extended position.

Additional functions that may be controlled using the operator controls 60 include further manipulation of the attachment 65 or forks 75. For example, a function may include rotating the attachment 65 or forks 75 to a left side or a ride side of the industrial vehicle 50. Further functions may include side shifting or positioning the attachment 65 or forks 75 to the left or right. Other functions include tilting, slewing, and/or centering the attachment 65 or forks 75. As will be described further, the attachment 65 may also include a pantograph mechanism 200 that allows the operator to retract or extend the forks 75 or other attachments, as shown in FIGS. 2 and 3. Some or all of these functions may be powered by a hydraulic motor (not shown) that may reside in the motor compartment 85, for example.

FIG. 2 illustrates a front view of the industrial vehicle 50 with the attachment 65 and forks 75 side-shifted and rotated to a left side of the operator cabin 55 (shown on the right side of the drawing). The operator cabin 55 and operator controls 60 are shown in an elevated position with the main mast 80 raised. The operator cabin 55 may be elevated, for example, when retrieving a load from a storage rack. With the pantograph mechanism 200 in a retracted position, the forks 75 are shown adjacent to, and unable to engage, a load 220.

FIG. 3 illustrates how the industrial vehicle 50 may engage a load or object from a distance. Rather than repositioning the industrial vehicle 50 closer to the load 220, the operator may extend the pantograph mechanism 200 so that the forks 75 engage the load 220. Advantageously, the attachment 65 with pantograph mechanism 200 may be extended and retracted to varying distances depending on the location of the load 220 with respect to the industrial vehicle 50. The distance that the attachment 65 is extended may be controlled using the operator controls 60. The pantograph mechanism 200 may be actuated by a hydraulic pump and motor, an electric motor, or any other conventional actuating device.

Figure 4:
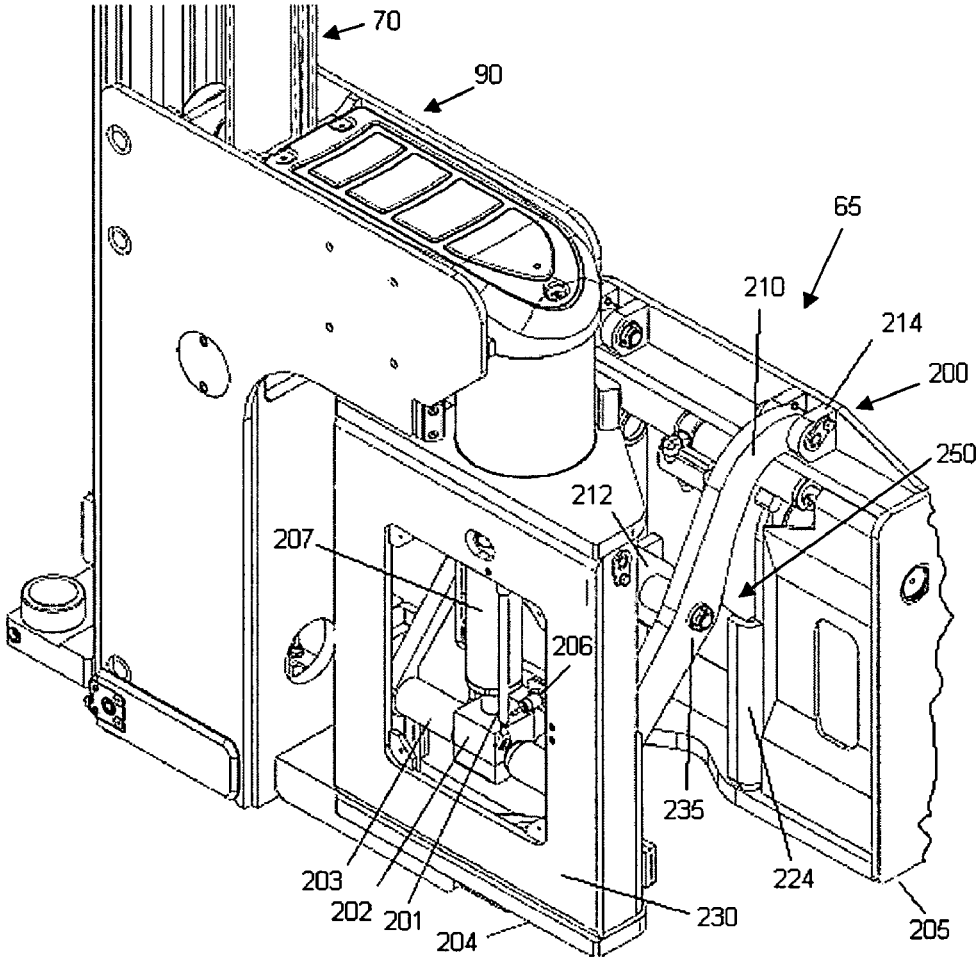
FIG. 4 is an enlarged partial rear showing the attachment in the extended position.

FIG. 4 is an enlarged partial rear view for one embodiment of the attachment mechanism 65 and pantograph mechanism 200. The attachment 65 in FIG. 4 is shown in an extended position where a rear section 204 is shown connected to a rotating attachment 90 that mounts to the auxiliary mast 70 of the industrial vehicle 50. In another embodiment, the attachment 65 is mounted directly to the auxiliary mast 70 or the main mast 80 shown in FIG. 1. Similarly, in another embodiment, the attachment 65 may be attached directly to the industrial vehicle 50.

An extending section 205 of the attachment 65 is shown connected to the rear section 204. The forks 75 or other type of load handling attachment may be mounted on a front face of the extending section 205 that is hidden from view in FIG. 4. The rear section 204 and the extending section 205 may be connected by a first support arm 210 that connects a top portion of the extending section 205 to a bottom portion of the rear section 204. Similarly, a second support arm 212 may connect a top portion of the rear section 204 to a bottom portion of the extending section 205. The first and second support arms 210 and 212, respectively, may be pivotally connected to each other at an approximate midpoint by a pivot or hinge 235, thereby forming a right support arm assembly 250.

The right support arm assembly 250 may be connected to the extending section 205 by a fixed position pivot point, such as pivot 214, and by a rail or guide bracket, such as bracket 224. A similar pivot such as pivot 217 (FIG. 5) and similar bracket such as bracket 227 (FIG. 5) may connect the right support arm assembly to the rear section 204, and is hidden from view by the rear plate 230 in FIG. 4. The attachment 65 may further include a hydraulic cylinder or other type of actuating device, such as actuator 207, which may be mounted to the rear section 204. The actuator 207 may also be connected to the first support arm 210 through a cylinder end block 202 and a connecting rod 203. A linear potentiometer or stroke gauge, such as a gauge 201 may be used to measure the amount of stroke in the actuator 207. Similarly, a proximity sensor 206 may be used to determine a distance between the rear section 204 and the extending section 205. Either or both of the gauge 201 and proximity sensor 206 may be used to determine an operating position of the attachment 65.

Figure 5:
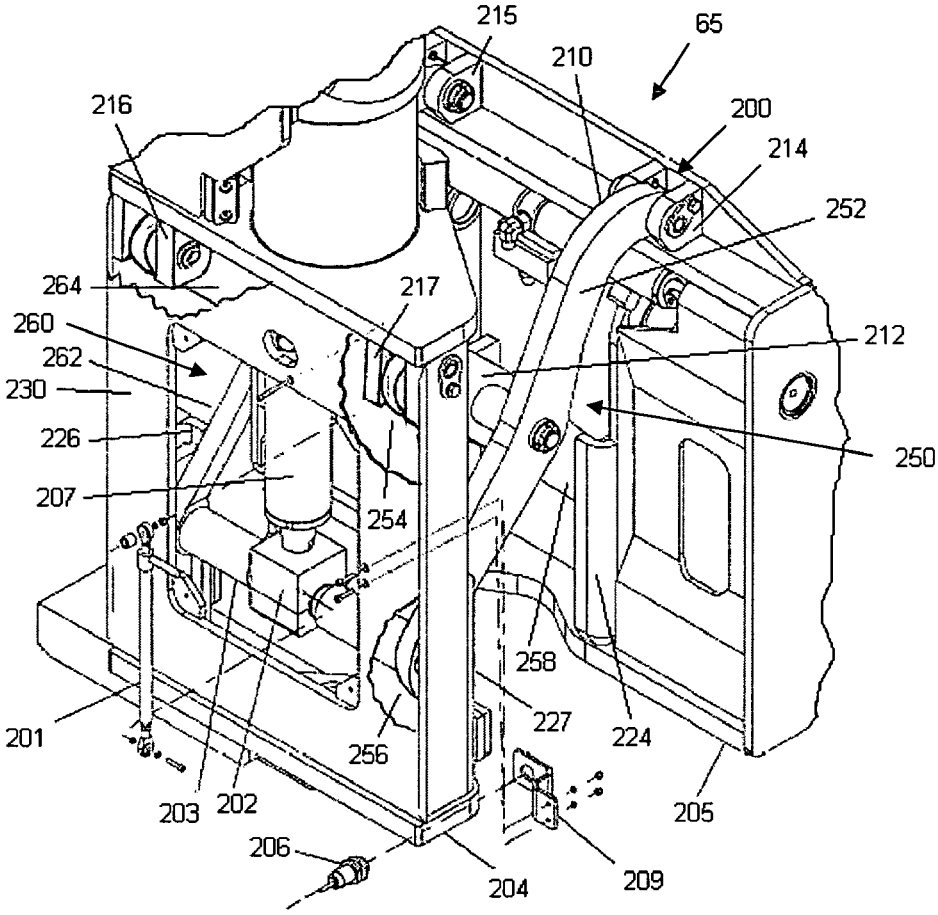
FIG. 5 shows the attachment of FIG. 4 in a partially exploded view.

FIG. 5 shows a partially exploded view of the attachment 65 with the rear plate 230 of FIG. 4 removed. As shown in FIG. 5, a first end 252 of the first support arm 210 may be connected to the extending section 205 by the pivot 214. A second end 256 of the first support arm 210 may be connected to the rear section 204 by bracket 227, which may be similar to bracket 224 as previously discussed. Likewise, the first end 254 of the second support arm 212 may be connected to the rear section 204 by a pivot 217, which may be similar to pivot 214. A second end 258 of the second support arm 212 may be connected to the extending section 205 by the bracket 224. The first ends 252 and 254 may also be thought of as fixed ends, wherein they are only allowed to rotate about pivots 214 and 217, respectively. Alternatively, the second ends 256 and 258 are free to move up and down in a vertical direction within brackets 224 and 227, respectively.

A scissor-like movement between the first and second support arms 210 and 212 in the right support arm assembly 250 may result when the second end 256 of the first support arm 210 is moved up or down in a vertical direction within the bracket 227. The second end 258 of the second support arm 212 moves in a vertical direction corresponding to the direction of the second end 256 of the first support arm 210. The scissor-like movement causes the extending section 205 to extend or retract with respect to the rear section 204.

A left support arm assembly 260 in the attachment 65 may include first and second support arms 262 and 264, similar to support arms 210 and 212. The left support arm assembly 260 may also include two pivots 215 and 216, similar to pivots 214 and 217. Further, the left support arm assembly 260 may include two brackets such as bracket 226 and a hidden second bracket, hidden from view in FIG. 5. Bracket 226 and the hidden second bracket may be similar to brackets 227 and 224. Both support arm assemblies 250 and 260 may facilitate extending, retracting and supporting the extending section 205, with both support arm assemblies 250 and 260 performing the scissor-like movement at the same time. The left and right support assemblies 250 and 260 together comprise the pantograph mechanism 200 in FIGS. 2 and 3.

Other embodiments of pantograph mechanisms are contemplated and claimed herein, including linking together four or more support arms in each support arm assembly to provide for a double-reach.

The actuator 207 may be mounted on either the rear section 204 or the extending section 205, but in FIG. 5 is shown mounted to the rear section 204. As previously discussed, the actuator 207 is attached to the cylinder end block 202 which in turn is attached to a connecting rod 203. The connecting rod 203 is shown attached to the second end 256 of the first support arm 252 for the right support arm assembly 250 and to the second end of the first support arm 262 of the left support arm assembly 260. The actuator 207 shown in FIGS. 4 and 5 is shown in a compact position. With the actuator 207 in the compact position, a distance between the second end 256 of the first support arm 210 and the first end of the second support arm 212 is minimized. In this compact position, the extending section 205 is in a fully extended position. The extended position of the attachment 65 corresponds to the operation of the industrial vehicle 50 shown in FIG. 3.

The gauge 201 may be connected between a top end of the rear section 204 and the cylinder end block 202, for example, to determine the amount of stroke in the actuator 207 (FIG. 4).

In this manner, the gauge 201 may be used to determine if the actuator 207 is in a compact position. Similarly, the proximity sensor 206 may be mounted to a bracket 209 attached to the rear section 204. The proximity sensor 206 may be used to determine if the extended section 205 is in an extended position, as shown in FIG. 5. The proximity sensor 206 may also be attached to the front section 205, and perform the same or similar function.

Figure 6:
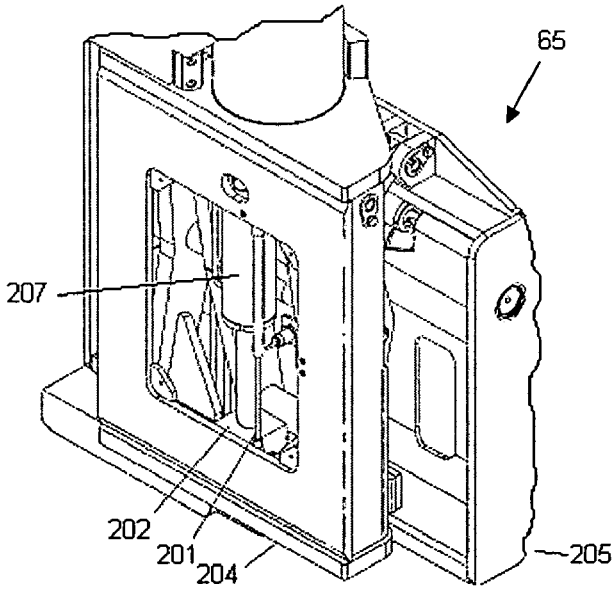
FIG. 6 shows the attachment of FIG. 4 in a retracted position.

FIG. 6 illustrates the attachment 65 in a retracted position, with the actuator 207 in an elongated position. The retracted position of the attachment 65 corresponds to the operation of the industrial vehicle 50 shown in FIG. 2. As the actuator 207 is elongated, cylinder block 202 is lowered causing the extending section 205 to retract towards the rear section 204. The gauge 201 may be used to determine if the actuator 207 is in an elongated position, in a compact position, or any intermediate position. Similarly, the proximity sensor 206 may be used to determine if the extended section 205 is in an extended position, as shown in FIG. 5, or in a retracted position, as shown in FIG. 6,.

The position of the pantograph mechanism 200 may be electronically adjusted to permit variable pantograph stroke depending on certain vehicle operations. The gauge 201 and proximity sensor 206 may be used to measure or control the actuator stroke and the pantograph stroke, respectively. The actuator stroke may be adjusted to allow a variable pantograph travel under certain vehicle operating conditions.

Figure 7:
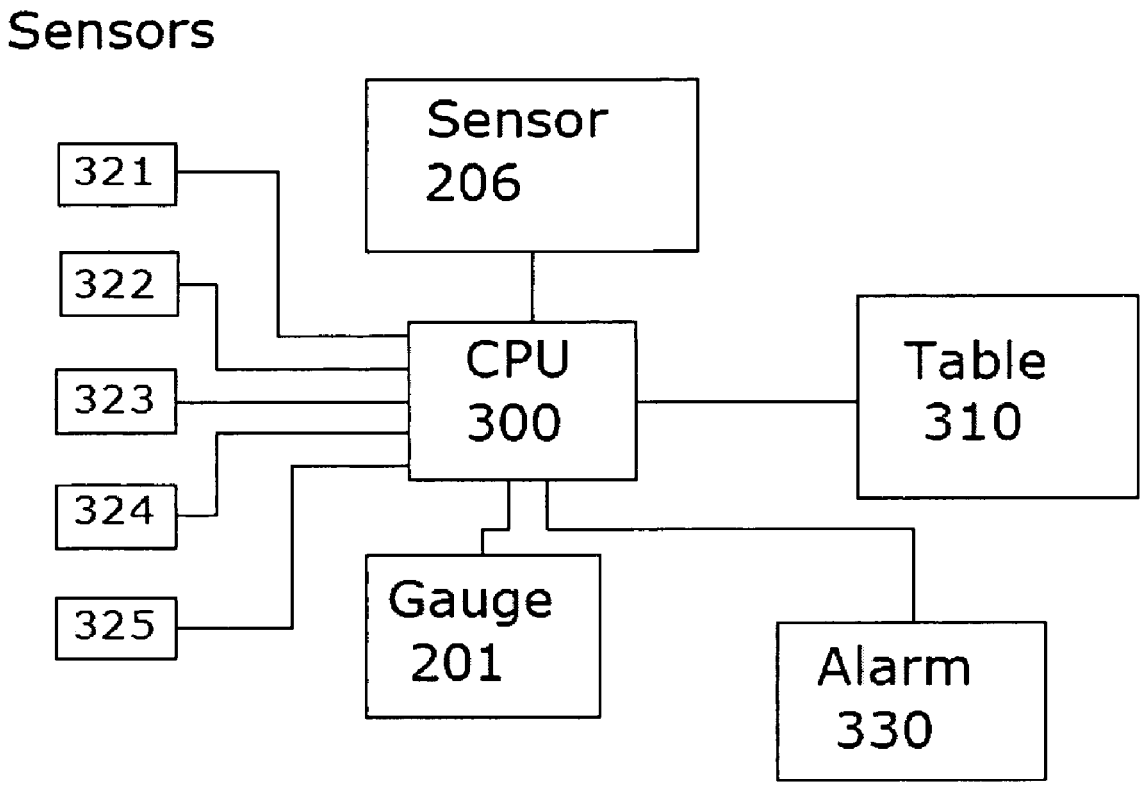
FIG. 7. is a simplified block diagram of a control system used with the attachment.

FIG. 7 is a simplified block diagram including an on-board processor 300, look-up table 310, gauge 201, proximity sensor 206, multiple vehicle sensors 321-325 and an optional alarm 330. FIG. 7 illustrates how inputs from multiple sensors 321-325 may be used to determine a maximum allowable reach of the pantograph mechanism 200. Sensors 321-325 may include a travel speed sensor 321, lift height sensor 322, load weight sensor 323, vehicle weight sensor 324, and a steer angle sensor 325. Alternative embodiments may use more or fewer sensors or different combinations of sensors. All of the sensors 321-325 may be located on the industrial vehicle 50. Similarly, the on-board processor 300 may be located on the industrial vehicle 50, and may receive input or feedback from each of the sensors 206 and 321-325 as well as gauge 201.

During operation of the industrial vehicle 50, the sensors 321-325 may provide continuous input to the processor 300 as operating conditions change. For example, vehicle speed sensor 321 may provide values associated with a travel speed of the industrial vehicle 50 over a given period of time. The processor 50 may determine an instantaneous travel speed of the industrial vehicle 50 or whether the industrial vehicle 50 is accelerating or decelerating, for example. The lift height sensor 321 may provide information to the processor 300 associated with the height of the load 220 (FIGS. 2 and 3).

The load weight sensor 323 may provide information on a load weight used for determining a load moment. One or more vehicle weight sensors 324 may measure one or more wheel reactions of the industrial vehicle 50. The steer angle sensor 325 may detect the angle of vehicle steering requested for the industrial vehicle 50.

Significantly, the input from one or more of the sensors 321-325, including the proximity sensor 206, may be combined and evaluated collectively by the processor 300 to determine the overall affect on the stability of the industrial vehicle 50. The proximity sensor 206 provides information related to a distance the pantograph mechanism 200 is retracted or extended which also may affect vehicle stability.

The processor 300 evaluates the sensor inputs to determine a maximum allowable reach of the pantograph mechanism 200 according to a computer algorithm or other data located in a look-up table 310. According to the maximum allowable reach, the processor can monitor the gauge 201 to limit the amount of stroke in the actuator 207 in FIGS. 2-6. Other methods of controlling a stroke of a hydraulic cylinder may be utilized, such as by controlling a hydraulic valve or solenoid for example.

By constantly evaluating and comparing the input received from the sensors 321-325, and from the proximity sensor 206, the processor 300 can additionally utilize the gauge 201 to actively control an amount of attachment reach. Additionally, or alternatively, the processor 300 may be programmed to activate an alarm 330 or other indicator when a current attachment reach has exceeded or is about to exceed a maximum allowable value for attachment reach. In one example, an alarm 330 may sound, but the operator would not be restricted in any operation of the industrial vehicle 50. In another embodiment, one or more operations of the industrial vehicle 50 may be limited or disabled, such as vehicle acceleration, vehicle steering, attachment lift, attachment extend, and/or vehicle braking. In this manner, the vehicle operating parameters may be restricted to operating conditions that results in the current attachment reach being less than the maximum allowable attachment reach.

Generally, as a value associated with one or more sensors 321-325 increases, the maximum allowable reach of the pantograph mechanism 200 decreases. A combined analysis of data received from the sensors 321-325 and the proximity sensor 206 may be used by the processor 300 to determine an analytical stability profile for the industrial truck 50. This stability profile can be used to determine how much attachment reach may be allowed while maintaining sufficient stability safety margins as may be established by industrial or government standards, for example.

In one embodiment, a full attachment reach would be allowed when the attachment 65 or operator cabin 55 is in a lowered position, whereas a minimum or zero attachment reach may only be allowed when the attachment 65 is in a fully raised position. A load 220 that is being lifted with the attachment 65 fully raised may result in a reduced vehicle stability, in part due to a raised vehicle center of gravity, and in part due to a mast sway in the main mast 80, for example. Restricting the amount of attachment reach with the attachment 65 fully raised may help to improve the vehicle stability and performance, and also minimize damage to the attachment 65 or load 220.

The processor may be configured to limit the stroke of the pantograph mechanism 200 according to a lift height and load weight. In this manner, full pantograph extensions may be allowed at maximum lift height for light loads and at lower lift heights with heavier loads.

The processor 300 may be reprogrammed or provided with software modules, for example, or the table 310 may be repopulated, such that a parameter setting of the pantograph mechanism 200 may be adjusted according to different operating conditions, new attachments, different operator preferences and regulations. In this manner, the behavior and operation of the industrial truck 50 may be updated or changed in the field, for example, by a technician or service personnel.

Providing the industrial vehicle 50 with the adjustable pantograph mechanism 200 described herein provides the further advantages of minimizing a turning radius or required aisle width of the industrial vehicle 50, and extending the attachment reach. This allows for greater tolerance between the industrial vehicle 50 and load racks, for example, and may eliminate the need to double bite the load 220, or adjust the position of the load 220 on the forks 75.

The processor 300 may also be configured to determine an allowable steer angle based on an analysis of the sensors 206 and 321-324. For example, based on one or more values determined from the proximity sensor 206, travel speed sensor 321, lift height sensor 322, load weight sensor 323 and vehicle weight sensor 324, the processor 300 may determine an allowable steer angle in order to control a stability of the industrial vehicle 50. As any one value or combination of values increase, the allowable steer angle may be made to decrease. This processor 300 may recalculate the allowable steer angle according to a selected time interval or when any of the sensors 206 or 321-324 detect a change in value.

The steer angle sensor 325 may be used to provide the processor 300 with a current steer angle value. The processor 300 may therefore compare the current steer angle value with the allowable steer angle. The processor 300 may be programmed to activate the alarm 330 when a current steer angle has exceeded the allowable steer angle. In one embodiment, the alarm 330 may sound, but the operator would not be restricted in any operation of the industrial vehicle 50. In another embodiment, one or more operations of the industrial vehicle 50 may be limited or disabled, such as vehicle acceleration, attachment lift, attachment extend, and vehicle braking. In this manner, the vehicle operating parameters may be returned to an operating condition that results in a recalculated allowable steer angle that exceeds the current steer angle, and the alarm 330 is deactivated. In another embodiment, the current steer angle is not allowed to exceed the allowable steer angle as calculated by the processor 300.

In yet another embodiment, such as a three-wheel forklift or forklift truck with articulating axle, a lateral stability of the industrial vehicle increases with an increasing load weight. In this case, it may be desirable to increase the allowable steer angle when an increase in load weight is detected by the load weight sensor 323. The increase in load weight may allow an increased allowable steer angle while still maintaining an allowable lateral stability of the industrial vehicle according to a stability profile or regulatory standard, for example.

The processor 300 may be configured to determine an allowable lifting height based on an analysis of the sensors 206, 321 and 323-325. For example, based on one or more values determined from the proximity sensor 206, travel speed sensor 321, load weight sensor 323, vehicle weight sensor 324 and steer angle sensor 325, the processor 300 may determine an allowable lift height in order to affect a stability of the industrial vehicle 50. As any one value or combination of values increase, the allowable lift height may be made to decrease. This processor 300 may recalculate the allowable lift height according to a selected time interval or when any of the sensors 206, 321 or 323-325 detect a change in value.

The lift height sensor 322 may be used to provide the processor 300 with a current lift height value. The processor 300 may therefore compare the current lift height value with the allowable lift height. The processor 300 may be programmed to activate the alarm 330 when a current lift height has exceeded the allowable lift height. In one embodiment, the alarm 330 may sound, but the operator would not be restricted in any operation of the industrial vehicle 50. In another embodiment, one or more operations of the industrial vehicle 50 may be limited or disabled, such as vehicle acceleration, steer angle, attachment extend, and vehicle braking. In this manner, the vehicle operating parameters may be returned to an operating condition that results in a recalculated allowable lift height that exceeds the current lift height, and the alarm 330 is deactivated. In another embodiment, the current lift height is not allowed to exceed the allowable lift height as calculated by the processor 300.

Furthermore, the processor 300 may be configured to determine an allowable braking force based on an analysis of the sensors 206 and 321-325. Based on one or more values determined from the proximity sensor 206, travel speed sensor 321, lift height sensor 322, load weight sensor 323, vehicle weight sensor 324 and steer angle sensor 325, the processor 300 may determine an allowable braking force in order to control a stability of the industrial vehicle 50. As any one value or combination of values increase, the allowable braking force may be made to decrease. This processor 300 may recalculate the allowable braking force according to a selected time interval or when any of the sensors 206 or 321-325 detect a change in value.

Gauge 201 may alternatively be used to measure a current braking force, and provide the processor 300 with a current braking force value. The processor 300 may therefore compare the current braking force value with the allowable braking force. The processor 300 may be programmed to activate the alarm 330 when a current braking force has exceeded the allowable braking force. In one embodiment, the alarm 330 may sound, but the operator would not be restricted in any operation of the industrial vehicle 50. In another embodiment, one or more operations of the industrial vehicle 50 may be limited or disabled, such as vehicle acceleration, braking force, attachment lift, attachment extend, and steer angle. In another embodiment, the current braking force is not allowed to exceed the allowable braking force, as calculated by the processor 300.

As describe previously, a combined analysis of data received from the sensors 321-325 and the proximity sensor 206 may be used by the processor 300 to determine an analytical stability profile for the industrial truck 50. This stability profile may be used to determine the allowable steer angle, allowable lift height, or allowable braking force that may be allowed while maintaining sufficient stability safety margins as may be established by industrial or government standards, for example.

Similarly the processor 300 may evaluate the sensor input to determine the maximum allowable parameters of the industrial vehicle 50 according to a computer algorithm or other data located in a look-up table 310. The processor 300 may be reprogrammed or provided with software modules or the table 310 may be repopulated, such that the parameter settings may be adjusted according to different operating conditions, preferences and regulations. The behavior and operation of the industrial truck 50 may be updated or changed in the field, for example, by a technician or service personnel.

The system described above can use dedicated processor systems, micro controllers, programmable logic devices, or microprocessors that perform some or all of the operations. Some of the operations described above may be implemented in software and other operations may be implemented in hardware.

For the sake of convenience, the operations are described as various interconnected functional blocks or distinct software modules. This is not necessary, however, and there may be cases where these functional blocks or modules are equivalently aggregated into a single logic device, program or operation with unclear boundaries. In any event, the functional blocks and software modules or features of the flexible interface can be implemented by themselves, or in combination with other operations in either hardware or software.

Having described and illustrated the principles of the invention in a preferred embodiment thereof, it should be apparent that the invention may be modified in arrangement and detail without departing from such principles. I claim all modifications and variation coming within the spirit and scope of the following claims.

The invention claimed is:

1. A load handling apparatus of an industrial vehicle, the apparatus comprising:

a rear section configured to mount to the industrial vehicle;

an extending section configured to handle a load;

an extension apparatus that horizontally extends the extending section from the rear section;

a processor configured to calculate a maximum allowable horizontal extension of the extending section as a function of one or more vehicle operating parameters;

a weight sensor that determines a load weight, wherein the maximum allowable horizontal extension of the extending section is reduced as the load weight increases; and a proximity device that detects a horizontal extension distance between the rear and extending sections to determine a position of the load, wherein the processor evaluates the position of the load and the one or more vehicle operating parameters to calculate the maximum allowable horizontal extension of the extending section.

2. The apparatus of claim 1 wherein the one or more vehicle parameters include a vehicle travel speed, a lift height, or a vehicle steering angle.

3. The apparatus of claim 1 wherein the load handling apparatus is configured to rotate from a front facing direction to a left side and a right side of the industrial vehicle, and wherein the extending section is laterally extended to the left or the right of the industrial vehicle.

4. A load handling apparatus of an industrial vehicle, the apparatus comprising:

a rear section configured to mount to the industrial vehicle;

an extending section configured to handle a load;

an extension apparatus that horizontally extends the extending section from the rear section;

a processor configured to calculate a maximum allowable horizontal extension of the extending section as a function of one or more vehicle operating parameters;

a weight sensor that determines a load weight, wherein the maximum allowable horizontal extension of the extending section is reduced as the load weight increases; and a lift height sensor that determines a lift height of the load, wherein the maximum allowable horizontal extension of the extending section is further reduced as the lift height of the load increases.

5. A load handling apparatus of an industrial vehicle, the apparatus comprising:

a rear section configured to mount to the industrial vehicle;

an extending section configured to handle a load;

an extension apparatus that horizontally extends the extending section from the rear section;

a processor configured to calculate a maximum allowable horizontal extension of the extending section as a function of one or more vehicle operating parameters;

a weight sensor that determines a load weight, wherein the maximum allowable horizontal extension of the extending section is reduced as the load weight increases; and a travel speed sensor that determines a travel speed of the industrial vehicle, wherein the maximum allowable horizontal extension of the extending section is further reduced as the travel speed increases.

6. A load handling system of an industrial vehicle comprising:

a pantograph attachment providing a variable reach;

a sensor indicating a position feedback of the pantograph attachment; and a processor that determines a maximum allowable lateral reach of the pantograph attachment according to the position feedback and one or more vehicle operating parameters, wherein the maximum allowable lateral reach is reduced when one or more of the operating parameters are increased, and wherein the maximum allowable lateral reach is increased when one or more of the operating parameters are decreased.

7. The system of claim 6 wherein the one or more vehicle operating parameters include a vehicle travel speed, a load height, a load weight, a load moment, a vehicle axle reaction, or a vehicle steering angle.

8. The system of claim 6 including one or more vehicle sensors that transmit the one or more vehicle operating parameters to the processor, and a motor that extends or retracts the pantograph attachment according to the maximum allowable lateral reach determined by the processor.

9. The system of claim 8 wherein the processor recalculates the maximum allowable lateral reach of the pantograph attachment according to new vehicle operating parameters transmitted by the one or more vehicle sensors.

10. The system of claim 6 wherein the maximum allowable lateral reach of the pantograph attachment is determined with the pantograph attachment oriented in a rotated position with respect to the industrial vehicle.

11. The system of claim 6 wherein the one or more vehicle operating parameters comprise a vehicle travel speed, a lift height, or a vehicle steering angle.

12. A load handling system of an industrial vehicle comprising:

a pantograph attachment providing a variable reach;

a sensor indicating a position feedback of the pantograph attachment;

a processor that determines a maximum allowable lateral reach of the pantograph attachment according to the position feedback and one or more vehicle operating parameters;

one or more vehicle sensors that transmit the one or more vehicle operating parameters to the processor; and a motor that extends or retracts the pantograph attachment according to an instruction from the processor, wherein the maximum allowable lateral reach of the pantograph attachment is determined by the processor in real time by comparing a vehicle stability profile stored in a memory with the vehicle operating parameters currently monitored by the vehicle sensors.

13. The system of claim 12 including a sensor indicating a load weight, wherein the vehicle stability profile comprises a lateral stability of the industrial vehicle which varies as a function of the load weight, and wherein the processor further determines a maximum allowable steer angle of the industrial vehicle based on the lateral stability of the industrial vehicle.

14. The system of claim 12 wherein the one or more vehicle operating parameters comprises an acceleration of the industrial vehicle.

15. The system of claim 12 wherein the one or more vehicle operating parameters comprise a lift height.

16. A system for an industrial vehicle comprising:

a variable reach attachment configured to manipulate a load;

one or more sensors configured to detect a position of a variable reach attachment and a weight of the load; and a processor configured to:

derive a moment from the detected position and weight;

calculate a maximum allowable distance that the variable reach attachment may be extended according to the derived moment, wherein the position of the variable reach attachment is detected as being equal to or outside of the maximum allowable distance that the variable reach attachment may be extended; and limit or disable one or more vehicle operations when the variable reach attachment is detected as being equal to or outside of the maximum allowable distance.

17. The system of claim 16, wherein the position is detected according to a rotated position of the variable reach attachment with respect to the industrial vehicle.

18. The system of claim 16 wherein the one or more vehicle operations include: vehicle acceleration, vehicle steering, attachment lift, attachment extend, and vehicle braking.

19. The system of claim 16 wherein the processor is further configured to restrict the position of the variable reach attachment to the maximum allowable distance.

20. The system of claim 16 wherein the one or more sensors are further configured to detect a vehicle travel speed, a lift height, or a vehicle steering angle, and wherein the maximum allowable distance is further calculated according to the vehicle travel speed, the lift height, or the vehicle steering angle.

21. A load handling apparatus of an industrial vehicle, the apparatus comprising:

a rear section configured to mount to the industrial vehicle;

an extending section configured to handle a load;

an extension apparatus that horizontally extends the extending section from the rear section;

a processor configured to calculate a maximum allowable horizontal extension of the extending section as a function of one or more vehicle operating parameters;

a weight sensor that determines a load weight, wherein the maximum allowable horizontal extension of the extending section is reduced as the load weight increases; and a steer angle sensor that determines a steering angle of the industrial vehicle, wherein the maximum allowable horizontal extension of the extending section is further reduced as the steering angle increases.

* * * * *

UNITED STATES PATENT AND TRADEMARK OFFICE

CERTIFICATE OF CORRECTION

PATENT NO. : 7,599,777 B2
APPLICATION NO. : 11/404573
DATED : October 6, 2009
INVENTOR(S) : Passeri et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 464 days.

Signed and Sealed this

Twenty-eighth Day of September, 2010

David J. Kappos

David J. Kappos
*Director of the United States Patent and Trademark Office*